US009376903B2

(12) United States Patent
Kostrov et al.

(10) Patent No.: US 9,376,903 B2
(45) Date of Patent: Jun. 28, 2016

(54) METHOD AND APPARATUS FOR RESONANT OVER-PRESSURED WELL FRACTURING

(71) Applicants: Sergey Kostrov, Frisco, TX (US); William Wooden, Frisco, TX (US)

(72) Inventors: Sergey Kostrov, Frisco, TX (US); William Wooden, Frisco, TX (US)

( * ) Notice: Subject to any disclaimer, the term of this patent is extended or adjusted under 35 U.S.C. 154(b) by 0 days.

(21) Appl. No.: 14/174,112

(22) Filed: Feb. 6, 2014

(65) Prior Publication Data

US 2015/0218924 A1 Aug. 6, 2015

(51) Int. Cl.

| | |
|---|---|
| ***E21B 43/26*** | (2006.01) |
| ***E21B 43/00*** | (2006.01) |
| ***E21B 28/00*** | (2006.01) |

(52) U.S. Cl.

CPC ..... *E21B 43/26* (2013.01); *E21B 28/00* (2013.01)

(58) Field of Classification Search

CPC ..... E21B 43/26; E21B 43/003; E21B 47/00; E21B 28/00

USPC ..... 166/250.1, 380.1, 249

See application file for complete search history.

(56) References Cited

U.S. PATENT DOCUMENTS

| | | | | |
|---|---|---|---|---|
| 2,740,478 | A * | 4/1956 | Green et al. | 166/63 |
| 2,029,732 | A * | 4/1962 | Green et al. | 102/310 |
| 4,071,097 | A * | 1/1978 | Fulop et al. | 175/56 |
| 4,936,385 | A * | 6/1990 | Weaver et al. | 166/288 |
| 5,101,900 | A * | 4/1992 | Dees et al. | 166/288 |
| 5,131,472 | A * | 7/1992 | Dees et al. | 166/308.1 |
| 5,331,604 | A * | 7/1994 | Chang et al. | 367/31 |
| 5,443,123 | A * | 8/1995 | Wall et al. | 166/288 |
| 5,617,921 | A * | 4/1997 | Schmidt et al. | 166/308.1 |
| 5,669,448 | A * | 9/1997 | Minthorn et al. | 166/308.1 |
| 6,138,753 | A * | 10/2000 | Mohaupt | 166/250.02 |
| 8,459,351 | B2 * | 6/2013 | Kostrov et al. | 166/249 |
| 2004/0168805 | A1 * | 9/2004 | Fripp et al. | 166/297 |

OTHER PUBLICATIONS

Sobey,Ian, Oscillatory Flows at Intermediate Strouhal Number in Assymetry Channels, 1982, Journal of Fluids Mechanics, No. 125, pp. 359-373.*

Sakamoto, H; Haniu, H., A Study on Vortex Shedding from Spheres in Uniform Flow, Dec. 1992, Journal of Fluids Engineering, No. 112, pp. 386-392.*

* cited by examiner

*Primary Examiner* — Zakiya W Bates
*Assistant Examiner* — Silvana Runyan

(57) ABSTRACT

The method for enhancing of forming at least one fracture having a required width r and length L in the formation surrounding fracturing around a wellbore in the regime of resonance by means of applying vibrations to the formation which is undergoing pressurizing exceeding the fracture gradient pressure of the formation.

3 Claims, 3 Drawing Sheets

METHOD AND APPARATUS FOR RESONANT OVER-PRESSURED WELL FRACTURING

BACKGROUND OF THE INVENTION

The present invention relates to a method for fracturing the earth from a wellbore by over pressuring a fluid(s) and/or gases inside a wellbore under conditions of resonance.

BRIEF DESCRIPTION OF PRIOR ART

Fracturing the earth from a wellbore is a known technique for enhancing oil production and recovery from an oil bearing bed. A variety of methods have been proposed to create both short and long fractures near a wellbore. One of method is described and claimed in U.S. Pat. No. 5,617,921 by Schmidt et al., herein incorporated by reference, wherein a method for initiating and/or extending a fracture in an earth's formation from a well penetrating the formation utilizing a source of high pressure fracturing fluid disposed on the earth's surface which is released to flow into and through the well at a predetermined time to initiate and/or extend the fracture. However, this method requires a significant amount of energy and to have a relatively large diameter tubing string in which to hold a sufficient charge of pressured gas to provide an adequate fracture fluid pressure and flow characteristics.

The use of high pressured gas or other pressured fluid(s) in a wellbore to clean perforations and/or create fractures has been described in U.S. Pat. Nos. 5,669,448 and 5,131,472, herein incorporated by reference. These references disclose a method of stimulating a well by suddenly applying pressure to the formation in excess of the fracture gradient pressure and thereafter pumping fluid into the well before the pressure declines below the fracture gradient pressure. In addition, there are other more expensive means of injecting treatment liquids that have been proposed. One such type of approach is to place the treatment liquid in the well and ignite a gas generating propellant in the production string, as shown in U.S. Pat. Nos. 6,138,753; 5,443,123; 5,101,900; 4,936,385 and 2,740,478, herein incorporated by reference. Of more general interest is the disclosure in U.S. Pat. No. 3,029,732, herein incorporated by reference, While there have been a variety of methods proposed for creating hydraulic fractures around the wellbore, there remains a need for an effective, high-pressure method which creates a pattern of fractures extending from all perforations into the formation in particular with the required parameters of fractures.

SUMMARY OF THE INVENTION

Accordingly, a primary object of the present invention is to provide a method for enhancing of forming at least one fracture having a required width r and length L in the formation surrounding a wellbore in the regime of resonance by means of applying a vibrations to the formation which is undergoing a pressurizing process when a formation pressure exceeds the fracture gradient pressure of the formation as a result of pumping in of a fracturing fluid into a wellbore and farther into the formation through the perforations. In accordance with the invention, the method includes the steps of providing the pressurized fracturing fluid via tubing into a device for generating vibrations attached to the end of tubing inside the wellbore in the vicinity of the perforations and consisting of an elongated cylinder and plunger connected to a pumping means, and reciprocating upward and downward said plunger inside the elongated cylinder such that movement of plunger compresses liquid inside said tubing and generating the repetitive pulses of vibrations every time when said plunger exits out of a top of said elongated cylinder on upward movement of said plunger due to quick release of compressed liquid into said wellbore thereby generating vibrations having an amplitude varying between 15-35 MPa on a resonant frequency $f_r$ in accordance with following expression:

$$f_r = \frac{c}{2\pi}\sqrt{\frac{r}{1.2HL(r+W)}},$$

where $f_r$ is the frequency of resonance, c is a speed of sound in the fracturing fluid, π equals 3.1415, r is the required width of fracture, H is a combined thickness of a casing and a cement bond surrounding the casing, W is a length of a casing arch between two neighboring perforations, L is the required length of fracture.

It is another object of the present invention to provide the method for enhancing of forming at least one fracture having a required width r and length L in the formation surrounding a wellbore in the regime of resonance in which the repetitive pulses of vibrations provide with the rate from 10 times per hour to 20 times per minute.

It is another object of the present invention to provide the method for enhancing of forming at least one fracture having a required width r and length L in the formation surrounding a wellbore in the regime of resonance in which for known formation pore pressure $P_p$, formation density ρ, depth of perforations H and formation Poisson's ratio ν the amplitude of the repetitive pulses of vibrations $P_a$ is defined by the following expression:

$$P_a = \frac{1-\nu}{(1+\nu)(1-2\nu)}(1.8P_p - 0.9\rho gH)$$

where g is a gravity acceleration.

DETAILED DESCRIPTION

Figure 1:
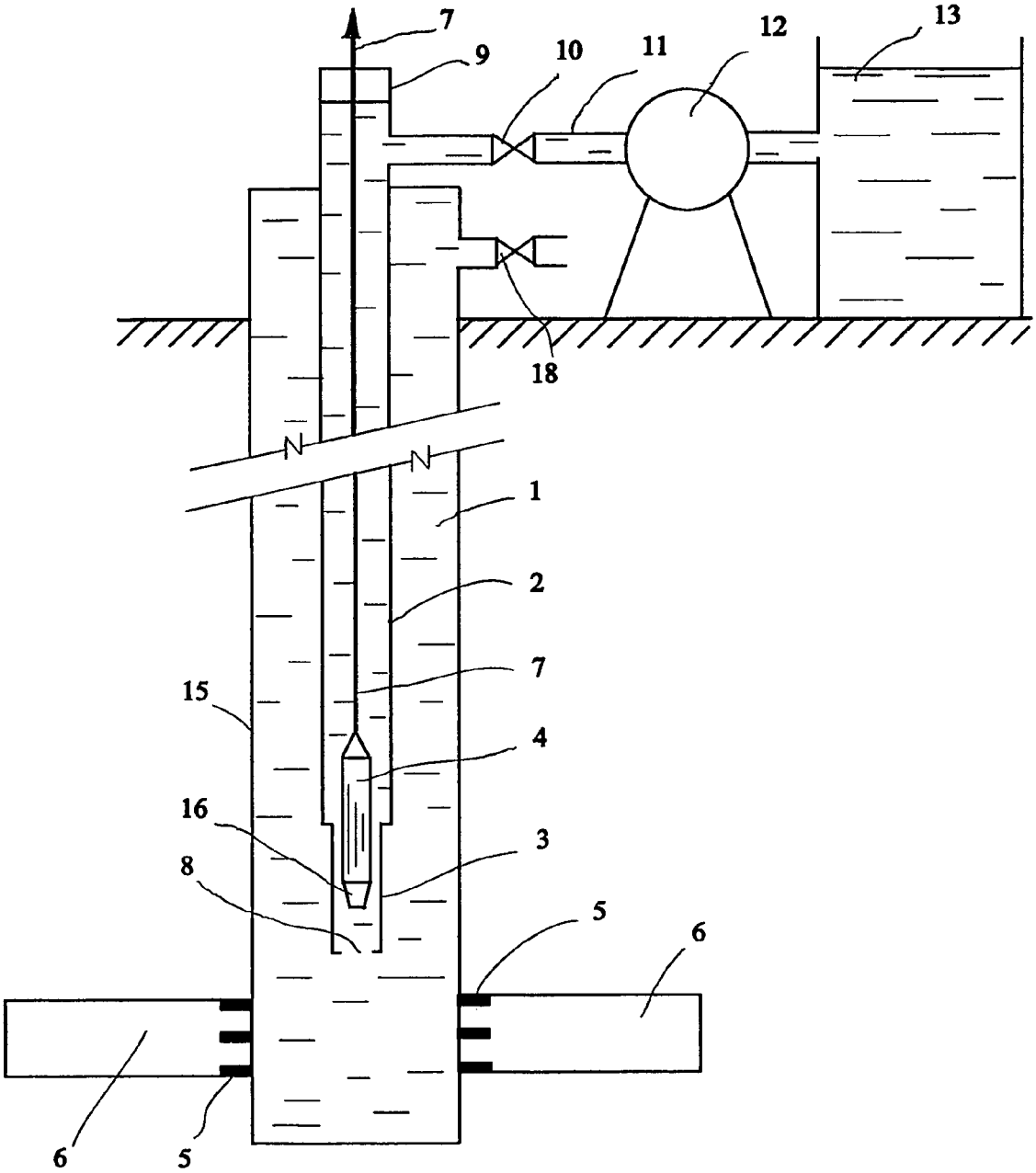
FIG. 1 shows a schematic illustration of the wellbore in which the method and the apparatus of the present invention is employed.
Figure 2:
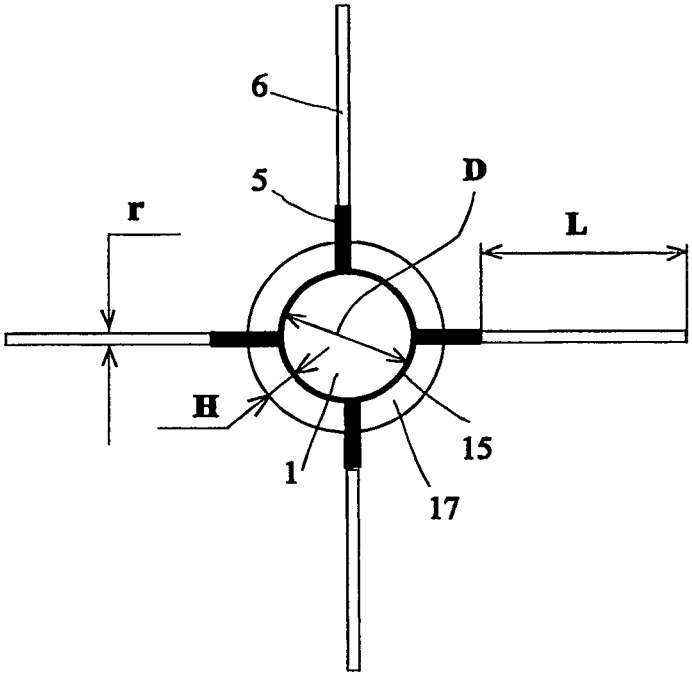
FIG. 2 is a cross-sectional top view of the wellbore and the formation with the fractures.

Referring to FIG. 1 and FIG. 2, there is shown the wellbore 1 having perforations 5 and fractures 6. FIG. 1 shows a general arrangement of a device for generating vibrations and procedure using the vibrations, the flow line 11 at the surface supplying the pressurized fracturing fluid from tank 13 via pump 12 into wellbore 1, the check valve 10 which is closed when the pressure of fracturing fluid inside the tubing 2 is greater than the one in flow line 11 thereby preventing flow of fracturing fluid from the tubing 2 back into the flow line 11, the tubing string 2 connected to flow line 11 and extending downwardly into the wellbore 1, a device for generating vibrations consisting of the elongated cylinder 3 connected with the bottom of tubing string 2 at the upper end and having the opening 8 to wellbore 1, the plunger 4 having the taper 16 movably arranged within the elongated cylinder 3 to move within said elongated cylinder 3, the pumping means 7 (for instance, sucker rods which, in turn, are connected to pumping unit) connected with the plunger 4 for moving the plunger 4 within the elongated cylinder 3 and compressing the fracturing fluid contained between the check valve 10 inside the flow line 11 and plunger 4 inside the elongated cylinder 3 and discharging the compressed fracturing fluid into the wellbore 1 via the opening 8 when plunger 4 exits out of the elongated cylinder 3 on every upstroke of the pumping means 7 to generate the vibrations due to the creating a periodic vortices in accordance with well known phenomenon of an auto-oscillations discovered by V. Strouhal in $19^{th}$ century. A lubricator 9 accommodates a pumping means 7 to prevent the leakage of the compressed fracturing fluid from the tubing string 2 and flow line 11 at the surface. More details about phenomenon of auto-oscillations could be found for example in the articles: Sobey, Ian J. (1982). "Oscillatory flows at intermediate Strouhal number in asymmetry channels". Journal of Fluid Mechanics, N. 125: 359-373, herein incorporated by reference, and Sakamoto, H.; Haniu, H. (1990). "A study on vortex shedding from spheres in uniform flow". Journal of Fluids Engineering, N 112 (December 1992): 386-392, herein incorporated by reference.

Figure 3:
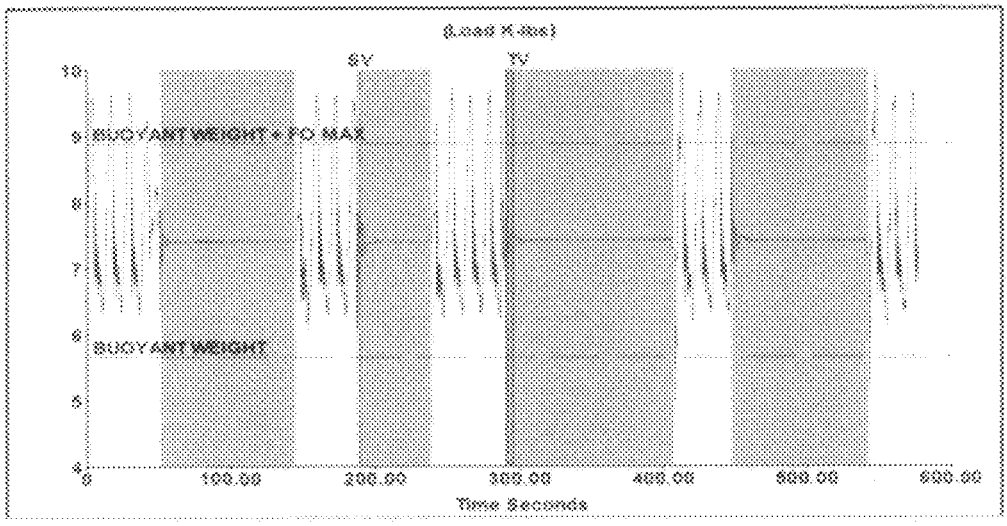
FIG. 3 is a measured dynamometer diagram of repetitive pulses of load provided by device for generating vibrations.

The generation of vibrations is repetitive and occurs in the form of bursts or so called hydro-impact waves/pulses at the moment when plunger 4 exits out of the elongated cylinder 3 due to the upward motion of the pumping means 7. The pumping means 7 provide a reciprocating upward and downward movements of the plunger 4 inside the elongated cylinder 3. The number or rate of reciprocating movements may vary from a few per hour to a dozens per minute depending on the particular fracturing operation. FIG. 3 shows the typical measured dynamometer diagram of repetitive load pulses created by device for generating vibrations. The amplitude of bursts/pulses may vary between 15-35 MPa depending on the type of formation undergoing fracturing. For relatively soft formation like, for instance, the unconsolidated sandstones this amplitude should be lower compared to hard formation like the deep shales. In case the characteristics of formation are known, i.e. the formation pore pressure $P_p$, the formation density ρ, the depth of perforations H and the formation Poisson's ratio ν the amplitude of the repetitive pulses of vibrations $P_a$ is defined by the following expression:

$$P_a = \frac{1-\nu}{(1+\nu)(1-2\nu)}(1.8P_p - 0.9\rho gH),$$

where g is a gravity acceleration. In particular, for formation pore pressure $P_a$, the formation density ρ, the gravity acceleration g, the depth of formation H and Poisson's ratio ν accounting for 45 MPa, 2300 kg/m$^3$, 9.81 m/s$^2$, 3000 m and 0.25, correspondingly, the amplitude of the repetitive pulses of vibrations $P_a$ accounts for 24 MPa.

Figure 4:
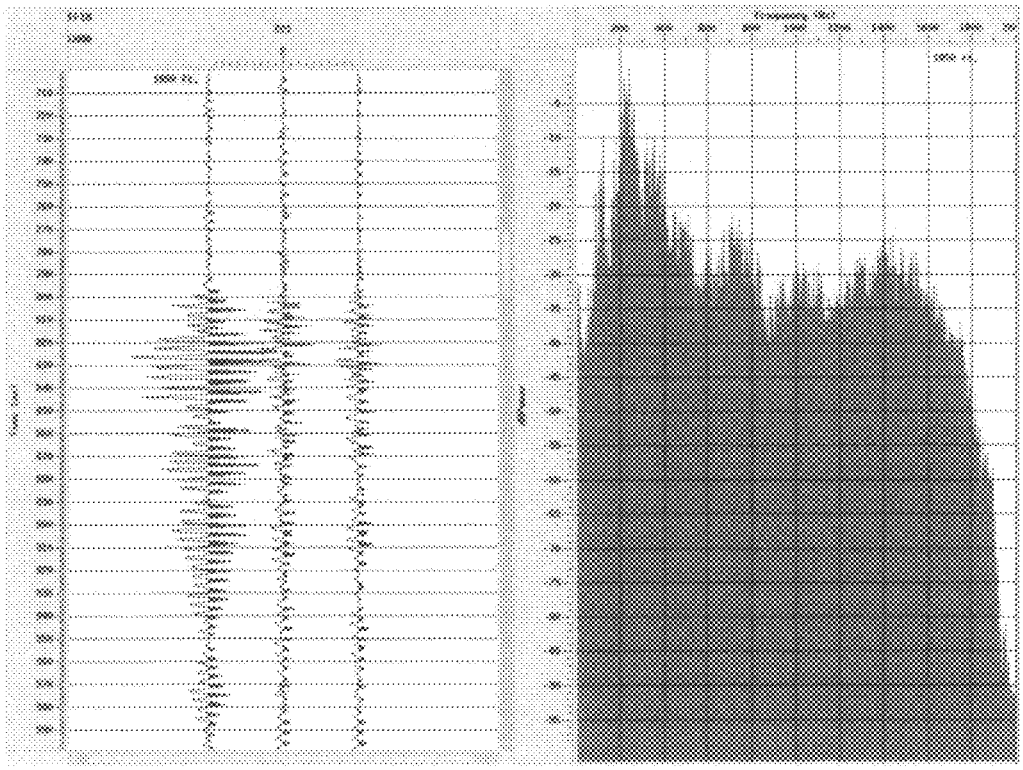
FIG. 4 is a waveform and spectrum of a single burst/pulse provided by device for generating vibrations.

The typical measured waveform of a single burst and corresponding spectrum are shown on FIG. 4. The diagram/waveform on the left part of FIG. 4 shows the signal from device for generating vibrations recorded by a geophone and two geophones, namely, horizontal and vertical ones in the offset well located on the distance of 1385 feet from the well wherein the device for generating vibrations was installed. The duration of the bursts accounts for 40-100 milliseconds depending on pressure of the compressed fracturing fluid between the plunger 4 and the check valve 10. A main or resonance frequency of generated vibrations can be "moved" along the frequency axis to the left or right on the spectrum diagram by providing the device for generating vibrations having an ability to create vibrations on a particular resonant frequency, i.e. the frequency matching so called eigen frequency of fractures with predetermined or required width r and length L. As it is seen from FIG. 4 the amplitude of the resonant frequency is by about 30-50 times higher compared with the rest of frequencies in spectrum (the units on vertical axis are in decibels). The check valve 10 installed on a flow line 11 could have a simple design having a seat with round hole in the center of said seat and a ball having bigger diameter and matching said hole in such manner that when the pressure of fracturing fluid in front of ball is greater than behind the one the ball closes said round hole of said seat thereby preventing any backward flow of fracturing from flow line 11 into the tank 13. It should be noted that valve 18 during fracturing has to be either closed or at least one standard packer (not shown) is installed between tubing 2 and casing 15 above the perforations 5. FIG. 2 shows the cross-sectional top view of the wellbore 1, a casing 15, cement bond 17, and the formation with the perforations 5 and the fractures 6. The eigen, natural or resonant frequency of such fractures (or slots in acoustics) is determined by the following formulae:

$$f_r = \frac{c}{2\pi}\sqrt{\frac{r}{1.2HL(r+W)}},$$

where $f_r$ is the frequency of resonance, c is a speed of sound in the fracturing fluid, π equals 3.1415, r is the required width of fracture 6, H is the combined thickness of the casing 15 and the cement bond 17 surrounding the casing, L is the required length of fracture 6, W is a length of the casing arch between two neighboring perforations 5. In particularly, for fracturing event shown on FIG. 3 (four fractures 6) W=πD/4, where D is the diameter of the casing 15. Thus, in order to get the fracture(s) 6 with particular parameters, i.e. the required width r and length L, the affecting vibrations have to be supplied on corresponding resonant frequency. For instance for the following parameters: r=0.02 m, H=0.05 m, L=100 m, W=0.13 m (corresponds to 7.0 inch casing and four fractures), c=1600 msec (corresponds to 70 MPa hydrostatic pressure under 20° C. temperature in wellbore) the resonant frequency equals 38 Hz. It should be noted that under conditions of resonance the fractures 6 will have predetermined, required width r and length L. It's important from the point of view of fracturing process when in case of too wide width r the excessive usage of proppant could be prohibitively expensive, and the fracture having too long length L can reach the highly water saturated sublayer of formation leading to the production of excessive portion of water instead of oil or gas from fractured well.

As an alternative source of the said vortices generating vibrations on resonant frequency, for instance, can be used the devices described in U.S. Pat. No. 8,459,351, herein incorporated by reference.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

What is claimed is:

1. A method for enhancing of forming at least one fracture having a required width r and length L in a formation having a wellbore penetrating said formation and communicating therewith through a multiplicity of perforations by providing vibrations on a resonant frequency and comprising the steps of:

a) providing a pressurized fracturing fluid in said wellbore at a pressure exceeding a fracture gradient pressure of said formation;

b) arranging a device for generating vibrations attached to an end of a tubing inside the wellbore in a vicinity of said perforations and consisting of an elongated cylinder and plunger connected to a pumping means;

c) reciprocating upward and downward said plunger inside said elongated cylinder by pumping means such that movement of plunger compresses fracturing fluid inside said tubing and generating the repetitive pulses of vibrations every time when said plunger exits out of a top of said elongated cylinder on upward movement of said plunger due to quick release of compressed fracturing fluid into said wellbore;

d) generating the repetitive pulses of vibrations on every exit of said plunger out of said elongated cylinder and said vibrations have the resonant frequency determined by the following expression:

$$f_r = \frac{c}{2\pi}\sqrt{\frac{r}{1.2HL(r+W)}},$$

where $f_r$ is the resonant frequency, c is a speed of sound in the fracturing fluid, π equals 3.1415, r is the required width of fracture, H is a combined thickness of a casing and a cement bond surrounding the casing, W is a length of the casing arch between two neighboring perforations, L is the required length of fracture;

e) generating the repetitive pulses of vibrations having an amplitude in a range from 15.0 MPa to 35 MPa by said device for generating vibrations.

2. The method as defined in claim 1, wherein said repetitive pulses are provided with the amplitude of the repetitive pulses of vibrations Pa defined by the following expression:

$$P_a = \frac{1-\nu}{(1+\nu)(1-2\nu)}(1.8P_p - 0.9\rho gH)$$

where $P_p$ is the formation pore pressure, ρ is the formation density, g is a gravity acceleration, H is the depth of said perforations, ν is the formation Poisson's ratio.

3. The method as defined in claim 1, wherein said repetitive pulses are provided with a rate from 10 times per hour to 20 times per minute.

* * * * *